US006530189B2

(12) United States Patent
Freshwater et al.

(10) Patent No.: US 6,530,189 B2
(45) **Date of Patent: *Mar. 11, 2003**

(54) AESTHETIC, SELF-ALIGNING SHINGLE FOR HIP, RIDGE, OR RAKE PORTION OF A ROOF

(75) Inventors: John G. Freshwater, Bakersfield, CA (US); Willard Calvin Hudson, Jr., Arlington, TX (US); Clark Daniel Maytubby, Hanford, CA (US); Larry Scott Reed, Bakersfield, CA (US); Frank Clydean Richey, Bakersfield, CA (US); Younger Ahluwalia, Desoto, TX (US)

(73) Assignee: Elk Premium Building Products, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/849,732

(22) Filed: May 4, 2001

(65) Prior Publication Data

US 2002/0038531 A1 Apr. 4, 2002

Related U.S. Application Data

(63) Continuation of application No. 09/253,280, filed on Feb. 19, 1999, now abandoned.

(51) Int. Cl.[7] ..... E04D 1/00

(52) U.S. Cl. ..... 52/553; 52/199; 52/528; 52/560; 52/591.4; 52/DIG. 9

(58) Field of Search ..... 52/57, 199, 528, 52/553, 560, 591.4, DIG. 9, 148; 454/365

(56) References Cited

U.S. PATENT DOCUMENTS 2,168,218 A 8/1939 Kirschbraun
3,852,934 A 12/1974 Kirkhuff
3,913,294 A 10/1975 Freiborg (List continued on next page.)

OTHER PUBLICATIONS

ASTM Designation: D3381–92, Standard Specification for Visosity–Graded Asphalt Cement for Use in Pavement Construction, pp. 303–304.
Fina Oil and Chemical Company, Finaprene Thermoplastic Elastomer 409 Data Sheet, Dec. 1998 (1 page).
Fina Oil and Chemical Company, Finaprene Thermoplastic Elastomer 411 Data Sheet, Dec. 1998 (1 page).
UltraPave, Textile Rubber & Chemical Company, UP–70 Anionic SBR Latex Data Sheet (1 page).

(List continued on next page.)

*Primary Examiner*—Carl D. Friedman
*Assistant Examiner*—Brian E. Glessner
(74) *Attorney, Agent, or Firm*—Baker Botts, LLP

(57) ABSTRACT

There is provided a hip, ridge, or rake shingle, which includes a shingle panel and at least one rigid back member. The shingle panel has a substantially planar lower surface. The at least one rigid back member has a length substantially the same as or greater than the length of the shingle panel. The rigid back member is attached to the substantially planar lower surface of the shingle panel. The rigid back member includes a step in thickness in a cross-sectional plane perpendicular to the substantially planar lower surface and parallel to the longitudinal axis of the rigid back member. In addition, the thickness of the rigid back member at the high level of the step is greater than the thickness of the rigid back member at one of its ends. There is also provided an asphaltic adhesive including from about 62% to about 99% by weight of an asphalt cement; from about 0.5% to about 15% by weight of a first thermoplastic having a glass-transition temperature in the range from about 190° F. to about 260° F.; and from about 0.5% to about 15% by weight of a second thermoplastic having a glass-transition temperature in the range from about −55° F. to about 0° F.

14 Claims, 11 Drawing Sheets

U.S. PATENT DOCUMENTS

| | | | | |
|---|---|---|---|---|
| 4,301,633 | A | 11/1981 | Neumann | |
| 4,485,201 | A | 11/1984 | Davis | |
| 4,559,267 | A | 12/1985 | Freshwater et al. | |
| 4,577,442 | A | 3/1986 | Callaway | |
| 4,676,147 | A | 6/1987 | Mankowski | |
| 4,731,970 | A | 3/1988 | Marshall et al. | |
| 4,738,884 | A | 4/1988 | Algrim et al. | |
| 4,803,813 | A | 2/1989 | Fiterman | |
| 4,824,880 | A | 4/1989 | Algrim et al. | |
| 4,835,199 | A | 5/1989 | Futamura et al. | |
| 4,903,445 | A | 2/1990 | Mankowski | |
| 4,907,499 | A | 3/1990 | James | |
| 5,070,771 | A | 12/1991 | Mankowski | |
| 5,094,041 | A | 3/1992 | Kasner et al. | |
| 5,247,771 | A | 9/1993 | Poplin | |
| 5,295,340 | A | 3/1994 | Collins | |
| 5,305,569 | A | 4/1994 | Malmquist et al. | |
| 5,331,783 | A | 7/1994 | Kasner et al. | |
| 5,365,711 | A | 11/1994 | Pressutti et al. | |
| 5,369,929 | A | 12/1994 | Weaver et al. | |
| 5,375,388 | A | 12/1994 | Poplin | |
| 5,377,459 | A | 1/1995 | Freiborg | |
| 5,419,941 | A | 5/1995 | Noone et al. | |
| 5,458,538 | A | * 10/1995 | MacLeod et al. | 52/57 X |
| 5,471,801 | A | 12/1995 | Kupczyk et al. | |
| 5,502,940 | A | * 4/1996 | Fifield | 52/309.12 |
| 5,575,876 | A | 11/1996 | Noone et al. | |
| 5,676,597 | A | 10/1997 | Bettoli et al. | |
| 5,711,126 | A | 1/1998 | Wells | |
| 5,813,176 | A | 9/1998 | Tzeng et al. | |
| 5,816,014 | A | 10/1998 | Tzeng et al. | |
| 5,965,626 | A | * 10/1999 | Tzeng et al. | 52/57 X |
| 6,012,611 | A | 2/2000 | Wells et al. | |
| 6,125,602 | A | * 10/2000 | Freiborg et al. | 52/560 |
| 6,148,578 | A | 11/2000 | Nowachek et al. | |

OTHER PUBLICATIONS

Dupont Products Database Search Results (http://www.dupont.com/cgi–bin/corp/proddbx.cgl) printed Feb. 11, 1999 (1 page).

Shell Chemical–Online Literature "Kraton Polymers for Adhesives and Sealents" (http://www2.shellchemical.com/cmm?...SF/searchv/SC:2426–96?Open document) Printed Jan. 8, 1999 (10 pages).

Shell Chemical–Online literature Kraton Polymers and Compounds Tupical Properties Guide: (http://www2.shellchemical.com/cmm/WEB/Glob Chem.NSF/literature/SC:68–96) Printed Jan. 8, 1999 (11 pages).

Shell Chemical–Online literature Kraton Polymers—The Asphalt Modifier for America's Roofs (http://www2.shellchemical.com/cmm?...SF/searchv/SC:1800–95 Open Document) Printed Jan. 8, 1999 (11 pages).

Trimline Roof Ventilation Systems, "Media Kit—Rigid Roll Attic Ventilation System," Aug. 23, 1998 (13 pages).

Dow Chemical Company Brochure, Jun. 2, 1998, pp. 5–7.

Home Ventilating Institute, "Certified Home Ventilating Products Directory," Jun. 1998 (4 pages).

Dow Plastics, The Dow Chemical Company, "STYRON High–Impact Polystyrene Resins," May 1998 (24 pages).

Benjamin Obdyke Incorporated, Roll Vent— The Original Ridge Vent on a Roll, May 1998 (11 pages).

Inovate Manufacturing, LLC, Open Letter to Contractors, Apr./May 1998 (2 pages).

ICBO Evaluation Service, Inc., "Acceptance Criteria for Plastic Roof Vents AC132," Jan 1998 (2 pages).

Trimline Building Products, "Trimline—Advanced Ventilation Technology," 1998 (4 pages).

Benjamin Obdyke Incorporated, "Roll Out the Savings with Roll Vent," Oct. 1997 (2 pages).

GS Roofing Products Co., Inc., "A Real Hip Deal" (GS Sierra Ridge Brochure), Jun. 1997 (2 pages).

Benjamin Obdyke Incorporated, "Roll Vent Application & Architectural Drawings," Jan. 1997 (14 pages).

International Conference of Building Officials, 1997 Uniform Building Code, p. 1–146.

Benjamin Obdyke Incorporated, "Roll Vent Attic Ventilation System," 1997 (6 pages).

Inovate, Manufacturing, LLC, "Ready Ridge", 1997 (4 pages).

Building Officials and Code Administrators International, 1996 BOCA National Building Code, pp. 140–141.

Fine Homebuilding Magazine, Letter—"Cautions about ventilated drip edge" 1996, p. 6.

Kirth–Othmer, Encyclopedia of Chemical Technology, 1996, vol. 19, pp290–292, 881, and 891–892.

Gene Leger, "Hot Roof or Cold Roof," House Magazine, Apr. 1995, p. 6.

The ComboVent Company, Combo Vent Intake Soffit Vent Brochure, 1995 (2 pages).

Cor–A–Vent Inc., "Tile Roof Ventilation Systems, Application 9, Title", 1993 (6 pages).

Benjamin Obdyke Incorporated, Roll Vent Technical Bulletins, 1993 (6 pages).

Ridglass Shingle Manufacturing Co. Inc., Product Data, Dec. 1992 (2 pages).

Mike Daniels, "The 'baffling' evidence about ridge vents," RSI, Mar. 1992, pp. 32–33.

MBTechnology, "SBS Modified Bitumen Roofing Systems," 1992 (6 pages).

Ridge Manufacturing, Dura Ridge Product Brochure, May/Jun. 1990 (12 pages).

Ridge Products Corporation, "Data Sheet—The HighPoint Vent," Jan. 1990 (2 pages).

Ridge Products Corporation, "The Ridgeline Vent," Jan. 1990 (4 pages).

Ridge Products Corporation, "The Ridgeline Vent Installation Instructions," 1990 (2 pages).

North American Building Products, Inc., "HighPoint Vents", 1990 (4 pages).

Ridge–Rite Systems, Ridge–Rite Vent Cap, Specifications and Price, 1990 (1 page).

Benjamin Obdyke Incorporated, "Roll Vent Attic Ventilation System," 1990 (4 pages).

Greenstreak Plastic Products Inc., Top Cat Techical Data, Sep. 1989 (2 pages).

A.L. Bull and W.C. Vonk, "Thermoplastic Rubber/Bitumen Blends for Roof and Road," Shell Elastomers, Thermoplastic Rubbers Technical Manual TR 8:15, 2nd Edition, Sep. 1998 (30 pages).

Cor–A–Vent Inc., "The Ridge Vent with the Shingle on Top", 1988 (8 pages).

Air Vent, Inc., A CertainTeed Company, "List Prices," Aug. 15, 1988.

Elk, Elk Z Ridge Premium HIP and Ridge Shingles Brochure (2 pages).

Leigh Universal Ridge Vent Brochure (1 page).

Cor–A–Vent HIP Ventilator Installation Instructions (1 page).

Mid–America Building Products Corporation, RidgeMaster Vent Installation Instructions (1 page).
Air Vent Inc., A CertainTeed Company, "Filtervent™ Products, Architectural Drawings and Installation Instructions", First Edition (16 pages).
Air Vent Inc., A CertainTeed Company, Shinglevent II Brochure (4 pages).
Cor–A–Vent Inc., Ridge Vent System Brochure (2 pages).
Cor–A–Vent Inc., "The New Concept in Tile Roof Ventilation" (4 pages).
PABCO Roofing Products, "Super–Ridge Hip & Ridge Roofing Accessory" (2 pages).
Greenstreak Plastic Products, Inc., Top Cat Product Brochure (2 pages).
Council of American Building Officials, "One and Two Family Dwelling Code" p. 92.
Builder Bulletin 85, p. 4.
North American Building Products, Inc., "Application on Ridge Pole Construction" (1 page).
Mid–America Building Products Corporation, RidgeMaster Brochure (4 pages).
Ridge–Rite Systems, "Ridge–Rite Ventilation" (4 pages).
Ridge–Rite Systems Corporation, "Ridge–Rite Vent Cap" (5 pages).
Ridglass Shingle Manufacturing Company, Inc., "Treat Your Roof to Ridglass" (2 pages).
Ridglass Shingle Manufacturing Company, Inc., "Fiberglass High Profile Hip and Ridge Cap with SBS Modified Asphalt!" (3 pages).
Ridglass Manufacturing Company, Inc. "Hip and Ridge" (1 page).
Ridge–Rite Systems Corporation, Ridge–Rite™ Vent Cap Installation Instructions (5 pages).
Gilroy, AT&T Bell Laboratories, "Polyolefin Longevity for Telephone Service", ANTEC '85, pp. 258–259 and 4 pages of charts.
Ledger, "Principles of attic ventilation", RSI, Mar. 1990, pp. 26–31.
Trimline, "Advanced Ventilation Technology—Roof Ventilation Products" (19 pages).
Northwest Building Products, Highpoint™ Ridge Vents, "High Performance Ventilators" (4 pages).
Ridge Manufacturing, Dura Edge and Dura Ridge Inquiry Card (2 pages).
North American Building Products Inc., "Data Sheet HighPoint Vent™ Series 5" (4 pages).
North American Building Products Inc., "Data Sheet HighPoint Vent™ Series 4" (4 pages).
North American Building Products Inc., "HighPoint—First All–Aluminum Shingle–Over Ridge Vent" (1 page).

* cited by examiner

AESTHETIC, SELF-ALIGNING SHINGLE FOR HIP, RIDGE, OR RAKE PORTION OF A ROOF

CROSS REFERENCE TO RELATED APPLICATIONS

This application is a continuation application under 37 C.F.R. §1.53(b) of application Ser. No. 09/253,280, filed Feb. 19, 1999, now abandoned.

BACKGROUND

The present invention relates generally to the construction of a shingle for covering the hip, ridge, or rake portion of a roof. In particular, the present invention relates to the construction of a hip, ridge, or rake shingle having a thick, aesthetic appearance and a self-aligning mechanism for the rapid and uniform installation of a number of such shingles.

In the roofing art, it is well-known to attempt to enhance the appearance of a non-wood hip, ridge, or rake shingle by increasing the height of such a shingle to simulate the height of a wood shingle. Examples of such shingles are provided in U.S. Pat. Nos. 5,471,801; 5,377,459; 5,247,771; and 3,913,294. In addition, another example of such a shingle is provided by the Z-Ridge® shingle product sold by Elk Corporation of Ennis, Tex. These shingles are constructed using creative folding designs for the shingle web material to create an overall shingle appearance that is thicker than that of the web material alone.

While these shingles provide an improved appearance over unfolded or flat shingles, they all suffer from common deficiencies. First, all of the shingles are difficult to align while installing and, thus, require great care in installation to avoid unsightly irregular appearances. Second, when installed, the shingles produce an exaggerated "saw-tooth" appearance, which is different than the more level appearance of wood shingles. Third, the shingles are difficult (if not impossible, in some cases) to install over "ridge vent" products (to be discussed below). Moreover, even in the best case, installation is a two-step process: the "ridge vent" products are nailed in place, followed by the installation of the ridge shingles. Finally, with time and heat, the folds in the shingles tend to compress and the shingles tend to droop and lose their wood-like appearance.

It is an object of the present invention to provide a hip, ridge, or rake shingle that overcomes these deficiencies.

SUMMARY OF THE INVENTION

According to the present invention, there is provided a hip, ridge, or rake shingle, which includes a shingle panel and at least one rigid back member. The shingle panel has a substantially planar lower surface and an upper surface. The back member has a length that is substantially the same as or greater than the length of the shingle panel. The back member is attached to the substantially planar lower surface of the shingle panel. The back member includes a step in thickness in a cross-sectional plane perpendicular to the substantially planar lower surface and parallel to the longitudinal axis of the back member. In addition, the thickness of the back member at the high level of the step is greater than the thickness of the back member at one of its ends.

Preferably, the shingle panel is composed of an asphalt material and the upper surface of the shingle panel includes a granular material thereon. Preferably, the composition of the shingle panel further includes a rubberized material. The rubberized material is preferably a styrene-butadiene-styrene block copolymer. Preferably, the back member is composed of an injection-molded thermoplastic. Alternatively, the back member may be composed of any rigid material suitable for outdoor exposure, such as molded recycled tire rubber, metal, or wood. If a thermoplastic is used, the back member may include from about 40% to 70% filler by weight.

Preferably, the back member includes a trapezoid-shaped base and a plurality of walls extending from the base. The step in thickness of the back member is provided by a step in the height of the walls in a cross-sectional plane perpendicular to the base and parallel to the longitudinal axis of the back member.

For installation with "ridge vent" systems (to be discussed below), the back member preferably includes channels formed therein communicating between a side of the back member and an area near the longitudinal center axis of the shingle panel. Preferably, the channels are formed in a zig-zag or herringbone pattern. Through the channels, the shingle according to the present invention is able to vent the air escaping through the ridge vent of the roof to the outside environment.

In yet another preferred embodiment of the invention, the back member includes a planar base surface that is attached to the substantially planar lower surface of the shingle panel. Opposite the planar base surface, the back member includes a surface inclined with respect to the planar base surface and a surface parallel to the planar base surface. At the juncture between the inclined surface and the parallel surface, there is formed the step in thickness of the back member. In this embodiment, the back member preferably includes cavities formed therein. The cavities lighten the back member, but at the same time do not substantially impair the rigidity of the back member.

According to another aspect of the present invention, the back member is attached to the shingle panel using a novel asphaltic adhesive. The asphaltic adhesive includes from about 62% to about 99% by weight of an asphalt cement; from about 0.5% to about 15% by weight of a first thermoplastic having a glass-transition temperature in the range from about 190° F. to about 260° F.; and from about 0.5% to about 15% by weight of a second thermoplastic having a glass-transition temperature in the range from about −55° F. to about 0° F.

The grade of the asphalt cement may be any of the grades specified by the American Society for Testing and Materials in Tables 1 to 3 of Publication D3381-92, entitled "Standard Specification for Viscosity-Graded Asphalt Cement for Use in Pavement Construction." A blend of different grades of asphalt cement may be used.

Preferably, the grade of the asphalt cement is AC-30 or below. In addition, it is preferred that the first thermoplastic is a styrene-butadiene-styrene block copolymer having a butadiene/styrene ratio in the range of about 68/32 to about 84/16, a block polystyrene in the range from about 30% to 32%, and an oil content in the range of from about 4.5 phr to 5.5 phr. It is also preferred that the second thermoplastic is a styrene-isoprene-styrene (SIS) block polymer or a latex having a molecular weight in the range of about 100,000 to about 100 million atomic units. The latex may be of a wide variety, including anionic latex, cationic latex, and a combination thereof. Preferably, the latex comprises a styrene-butadiene rubber polymer having from about 62% to about 70% polymer solids in water, a pH in the range of about 5.25 to about 10.5, and a monomer ratio of butadiene to styrene in the range from about 74/26 to about 78/22.

BRIEF DESCRIPTION OF THE DRAWINGS

Exemplary embodiments of the present invention will now be described in detail with reference to the accompanying drawings in which.

DETAILED DESCRIPTION OF THE INVENTION

Figure 1:
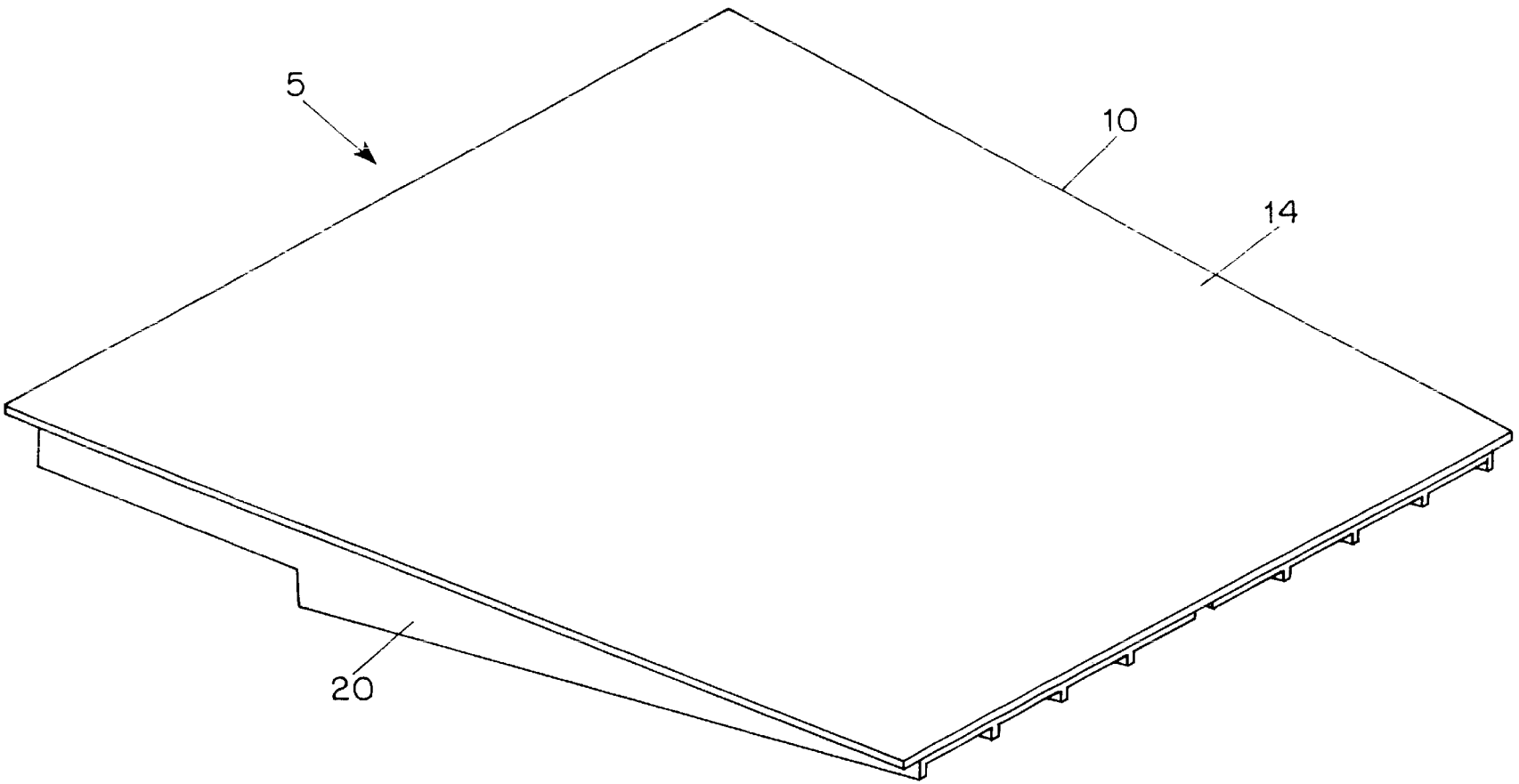
FIG. 1 is an isometric view of a shingle according to a preferred embodiment of the present invention.
Figure 2:
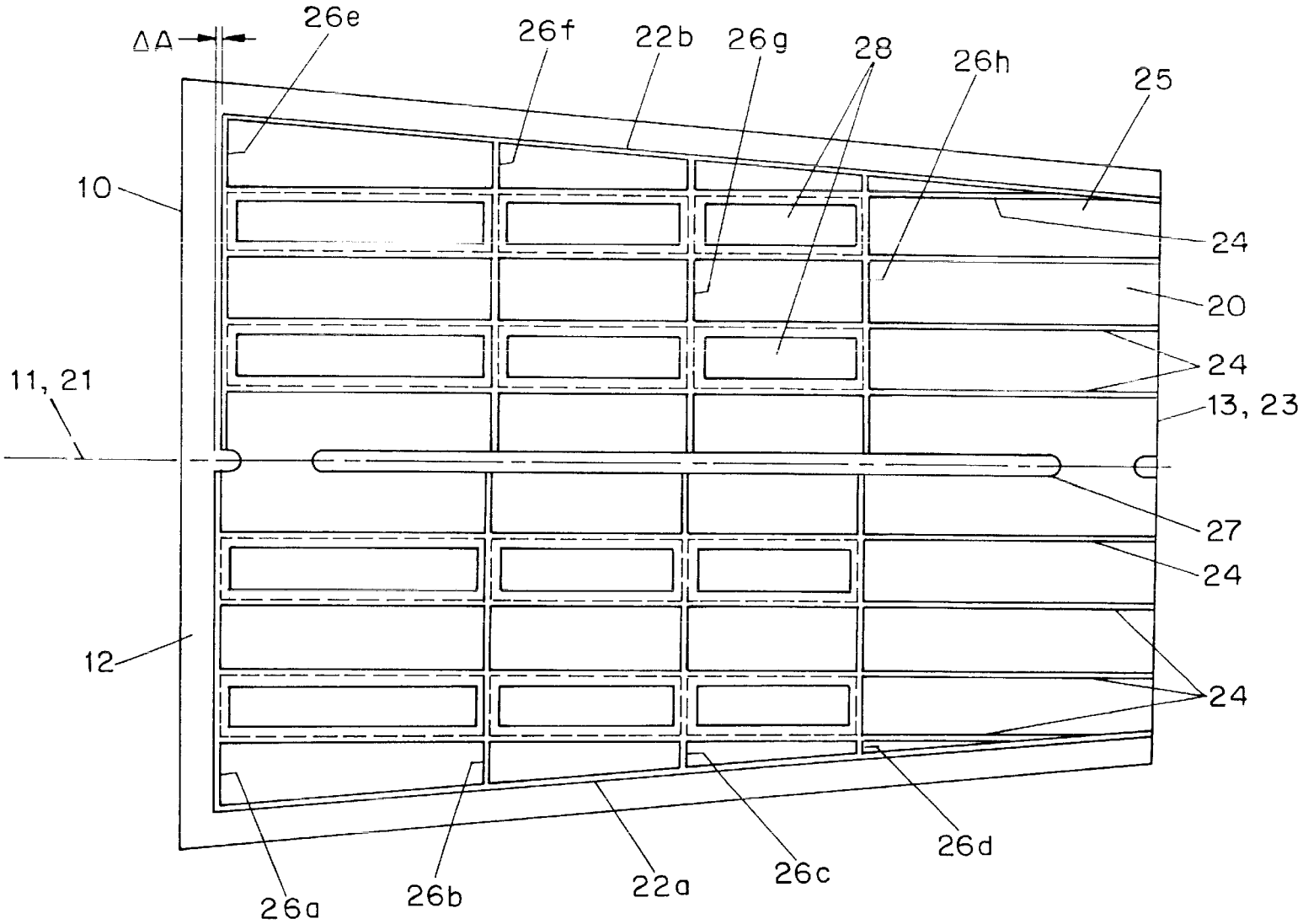
FIG. 2 is a bottom plan view of a shingle according to the embodiment of FIG. 1.

FIG. 1 is an isometric view of a shingle 5 according to a preferred embodiment of the present invention. The shingle 5 includes a shingle panel 10 and a back member 20, which is attached to the bottom surface 12 (see FIG. 2) of the shingle panel 10. The shingle panel 10 may be in the form of any symmetrical shape, such as a rectangle or a trapezoid. As shown in FIGS. 1 and 2, however, the shingle panel 10 is preferably trapezoid shaped because a trapezoid shape has been found to yield the best general appearance when the shingle 5 is installed.

The shingle panel 10 is composed of an asphalt material. Preferably, to enhance its flexibility and bending strength, the shingle panel 10 is composed of a fiberglass-based SBS-modified asphalt material, where SBS represents a styrene-butadiene-styrene block copolymier. As is well-known in the art the upper surface 14 of the shingle panel 10 (the surface facing away from the roof when the shingle is installed) contains granular ceramic material embedded therein (not shown).

The back member 20 may be attached to the shingle panel 10 by any suitable asphaltic adhesive. According to one aspect of the present invention, the back member 20 is preferably attached to the shingle panel 10 by a novel asphaltic adhesive comprising from about 62% to about 99% by weight of an asphalt cement; from about 0.5% to about 15% by weight of a first thermoplastic having a high glass-transition temperature ($T_g$); and from about 0.5% to about 15% by weight of a second thermoplastic having a low glass-transition temperature ($T_g$). A preferred range for each of said first and second thermoplastics is from about 1% to about 7% by weight.

As used in this specification and the appended claims, a high glass-transition temperature refers to a glass-transition temperature in the range from about 190° F. to about 260° F. and a low glass-transition temperature refers to a glass-transition temperature in the range from about −55° F. to about 0° F. The glass-transition temperature, as known to those skilled in the art, refers to the temperature above which a polymer exhibits liquid-like properties. Advantageously, by combining a thermoplastic with a high glass-transition temperature and a thermoplastic with a low glass-transition temperature, the asphaltic adhesive of the present invention provides excellent adhesive performance in both high temperatures and low temperatures. Thus, the asphaltic adhesive is suitable for a wide variety of geographic locations, including those locations having wide seasonal temperature variations.

As used in this specification and the appended claims, asphalt cement refers to vacuum distillation bottoms. The grade of the asphalt cement that may be used in the present invention includes any of the grades specified by the American Society for Testing and Materials ("ASTM") in Tables 1 to 3 of Publication D3381-92, entitled "Standard Specification for Viscosity-Graded Asphalt Cement for Use in Pavement Construction", which is incorporated herein by reference. A blend of different grades of asphalt cement may also be used. Preferably, the grade of the asphalt cement is AC-30 or below, as defined by the ASTM in Publication D3381-92. The requirements for asphalt cement of grade levels AC-30 and below are given in Table 1.

TABLE 1

Requirements for Asphalt Cement of Grades AC-30 and Below

| | Viscosity Grades | | | | |
|---|---|---|---|---|---|
| Test | AC-2.5 | AC-5 | AC-10 | AC-20 | AC-30 |
| Viscosity, 140° F. (60° C.), P | 250 ± 50 | 500 ± 100 | 1000 ± 200 | 2000 ± 400 | 3000 ± 600 |
| Viscosity, 275° F. (135° C.), min, cSt | 125 | 176 | 250 | 300 | 350 |
| Penetration, 77° F. (25° C.), 100 g, 5 s, min | 220 | 140 | 80 | 60 | 50 |
| Flash point, Cleveland open cup, min, ° F. (° C.) | 325 (163) | 350 (177) | 425 (219) | 450 (232) | 450 (232) |
| Solubility in trichloroethylene, min, % | 99.0 | 99.0 | 99.0 | 99.0 | 99.0 |
| Tests on residue from thin-film oven heat: | | | | | |
| Viscosity, 140° F. (60° C.), max, P | 1250 | 2500 | 5000 | 10000 | 150000 |
| Ductility, 77° F. (25° C.), 5 cm/min, min, cm | 100[a] | 100 | 75 | 50 | 40 |

[a]If ductility is less than 100, material will be accepted if ductility at 60° F. (15.5° C.) is 100 minimum at a pull rate of 5 cm/min.

The thermoplastic having a low glass-transition temperature may be a latex. The latex may be of a wide variety, including anionic latex, cationic latex, and a combination thereof, having a molecular weight in the range from about 100,000 to about 100 million atomic units. Examples of latex that may be used in the asphaltic adhesive of the present invention include butyl rubber latex, styrene-butadiene rubber latex, neoprene latex, polyvinyl alcohol emulsion latex, water-based polyurethane emulsion latex, water-based polyurethane elastomer latex, vinyl chloride copolymer latex, nitrile rubber latex, or polyvinyl acetate copolymer latex.

Preferably, the latex is a high molecular weight, high mooney viscosity styrene-butadiene rubber polymer latex that has the properties specified in Table 2.

TABLE 2

Latex Properties

| Property | Range of Values |
|---|---|
| Total Solids, % by weight | 62–70 |
| pH | 5.25–10.5 |
| Viscosity (Brookfield), cps | 800–1650 |
| Monomer Ratio (Butadiene/Styrene) | 74/26–78/22 |
| Pounds/Gallon Ratio | 7.7–8.1 |

Alternatively, instead of latex, the thermoplastic with the low glass-transition temperature may be a linear styrene-isoprene-styrene (SIS) block polymer, such as KRATON® D1107 thermoplastic, which is manufactured and sold by Shell Chemicals Ltd.

Preferably, the thermoplastic with a high glass-transition temperature is a styrene-butadiene-styrene (SBS) block copolymer having the properties specified in Table 3. The methods referred to in the last column of Table 3 are methods published by the American Society for Testing and Materials. Examples of SBS thermoplastics that be may used for the thermoplastic with the high glass-transition temperature include thermoplastics sold under the brand names KRATON® D1101 (manufactured and sold by Shell Chemicals Ltd.), FINA 409 (manufactured and sold by Fina Oil and Chemical Co.), and FINA 411 (manufactured and sold by Fina Oil and Chemical Co.).

TABLE 3

Styrene-Butadiene-Styrene (SBS) Properties

| Property | Range of Values | Method |
|---|---|---|
| Melt Flow at 180° C./5 kg (g/10 min) | 0.1–1.0 | ASTM D-1238 |
| Tensile Strength (psi) | 2300–4600 | ASTM D-638 |
| Elongation at break (%) | 550–820 | ASTM D-638 |
| 300% modulus (psi) | 240–800 | ASTM D-638 |
| Shore A Hardness | 71–82 | ASTM D-2240 |
| Butadiene/Styrene Ratio | 68/32–84/16 | |
| Block Polystyrene (%) | 30–32 | |
| Oil Content (phr) | 4.5–5.5 | |
| Specific Gravity at 23° C. (g/cm$^3$) | 0.92–0.95 | |
| Refractive Index | 1.44–1.64 | |
| Viscosity of 5.2% Toluene Solution (cSt) | 4–20 | |
| Color | White | |
| Form | Crumb and/or Powder | |

Table 4 lists specific adhesive formulations in accordance with the present invention. It is noted that the percentages used in Table 4 are by weight of the asphaltic adhesive. These formulations are hot-melt adhesives, which are applied at temperatures of between 300 degrees and 400 degrees F.

TABLE 4

Specific Adhesive Formulations

| | | Formulations | | | | | | | |
|---|---|---|---|---|---|---|---|---|---|
| Compound | Manufacturer | 1 | 2 | 3 | 4 | 5 | 6 | 7 | 8 |
| GB AC-20 | Golden Bear, Bakersfield, CA | 91.7% | 90.9% | | 94.3% | 91.7% | 92.2% | 92.6% | 91.7% |
| GB AC-S | Golden Bear, Bakersfield, CA | | | 91.2% | | | | | |
| UP-70 Latex SBR | UltraPave, Dalton, GA, | 1.4% | 1.4% | 1.3% | | | 1.4% | 0.9% | 1.4% |

TABLE 4-continued

| Compound | Manufacturer | Specific Adhesive Formulations: Formulations 1 | 2 | 3 | 4 | 5 | 6 | 7 | 8 |
|---|---|---|---|---|---|---|---|---|---|
| (Styrene-butadiene Rubber) | La Mirada, CA | | | | | | | | |
| UP-2897 Latex | UltraPave, Dalton, GA, La Mirada, CA | | | | 1.0% | | | | |
| KRATON D1107 (Styrene-isoprene-styrene) | Shell Chemicals Ltd. | | | | | 2.8% | | | |
| Fina 409 SBS (Styrene-butadiene-styrene) | FINA Oil and Chemical Co., Carville, LA | 6.9% | 7.7% | | 4.7% | 5.5% | 6.4% | 6.5% | |
| Fina 411 SBS (Styrene-buradiene-styrene) | FINA Oil and Chemical Co., Carville, LA | | | 7.5% | | | | | 6.9% |

Of the formulations listed in Table 4, formulations 1, 5, 7, and 8 are preferred based on adhesive performance as determined by a SLUMP test using 15–18 mil thick layers of the adhesive formulations. If cost-effectiveness of the formulations is taken into account, the preferred formulation is formulation 7. If expense is not a factor, formulation 5 is preferred overall because of its performance, ease of processing, ease of blending, and ease of storage.

Table 5 lists certain physical properties of the formulations of Table 4, where experimental data for these formulations was available. The physical properties listed in Table 5 are merely exemplary and are not intended to convey representative values. Indeed, as indicated by the data for two different samples of formulation 1, the properties in Table 5 may vary widely due to the variability in the properties of asphalt cement, even when the asphalt cement is of the same grade and obtained from the same manufacturer. The variation in these properties, however, does not greatly effect the adhesive performance of the formulations.

The mixing procedure for the formulations shown in Table 4 includes, first, heating the asphalt cement in a mixing tank to a temperature of between 325° F. to 375° F. Second, the SBS rubber is added to the asphalt cement, and the blend is mixed for about 45 to 120 minutes, until all of the SBS rubber is swelled and no rubber particles are observable. Next, the latex or the SIS thermoplastic material is added to the blend at a temperature of 350° F. If latex is added, caution should be used in adding the latex because the temperature of the blend will cause the water in the latex to evaporate or bubble out. Moreover, latex should be added very slowly to the hot blend as adding the latex too rapidly could splash the blend or could allow the blend to climb up on the mixing stirrer. On complete addition of the latex, the blend is mixed for about 30 minutes. The blend is then ready to use.

The mixing procedure has been described with reference to a mixing tank. Alternatively, instead of a tank, the mixing may also be performed by injecting the materials through in-line piping, as is well-known by those skilled in the art.

Cross-linking agents, from about 0.1% to about 2.5% by weight, may also be added to the formulations in Table 4. A

TABLE 5

| Physical Properties | Physical Properties of Formulations (Final Blend): Formulations 1 (Sample 1) | 1 (Sample 2) | 2 | 3 | 4 | 5 | 6 | 7 | 8 |
|---|---|---|---|---|---|---|---|---|---|
| Viscosities (centipoise) | | | | | | | | | |
| 350 F. | 608 | | | | | | 560 | 510 | |
| 360 F. | | 1162 | 1667 | 1767 | | | | | |
| 380 F. | | 845 | 1182 | 795 | | | | | |
| 400 F. | 399 | 630 | 907 | 540 | | | 373 | 315 | |
| 450 F. | 234 | | | | | | 218 | 180 | |
| Softening Point (F.) | 215 | 221 | 231 | 214 | | 197 | 208 | 210 | |
| Penetration (mm) | 38.2 | 35.0 | 31.0 | 41.0 | | | | 40.1 | |

preferred range for the cross-linking agents is 0.1% to 0.2% by weight. The addition of cross-linking agents allows less SBS to be used in each formulation; however, it also degrades the low-temperature performance of the asphaltic adhesive.

If cross-linking agents are to be added to the blend, the cross-linking agents are added after the latex or the SIS thermoplastic material is mixed in. After adding the cross-linking agents, the blend is mixed for about four hours at a temperature of 350° F. to 380° F. Examples of suitable cross-linking agents that may be used in the present invention include the agents sold under the brand names BUTAPHALT 720 (sold by Texpar Energy, Inc., Waukesha, Wis.), HVA-2 (sold by E. I. du Pont de Nemours and Company, Wilmington, Del.), and TETRONE (sold by E. I. du Pont de Nemours and Company, Wilmington, Del).

If latex is used in the asphaltic adhesive, it is noted that water will evaporate out of the latex over time and the polymers in the latex may cross-link with each other. Accordingly, if the asphaltic adhesive includes latex, the asphaltic adhesive will become thicker and more viscous over time.

The back member 20 is preferably manufactured from an injection-molded thermoplastic material, such as injected-molded polystyrene, polypropylene, or polyethylene. The polystyrene, polypropylene, or polyethylene materials may be low, medium, or high density and may be used with 40% to 70% filler by weight. Such filler may include limestone, gypsum, aluminum trihydrate (ATH), cellulose fiber, and plastic polymer fiber. Other thermoplastic materials that may be used include ethylene-vinyl-acetate (EVA) polymer materials, ethylene-mythylene-acrylate (EMAC) materials, neoprene materials, and polychlorosulfonated polymer (Hypalon) materials.

Although an injection-molded thermoplastic material is preferred for the manufacture of the back member 20, any rigid material suitable for outdoor exposure is also suitable. For example, molded recycled tire rubber, metal, or wood may also be used. If rubber is used, it is preferred that amine be added to each of the adhesive formulations in Table 4. Up to 5% amine by weight may be added, but because amine's odor is unpleasant, the addition of 0.1% to 0.2% amine by weight is preferred.

FIG. 2 is a bottom plan view of the shingle 5 of FIG. 1. As shown in FIG. 2, the base 25 of the back member 20 is also trapezoid-shaped, having substantially the same length as the shingle panel 10. For example, if the shingle panel 10 has a length of 13 ¼ inches, the back member may be 13 inches long. The back member 20 is attached to the shingle panel 10 such that the longitudinal center axis 11 of the shingle panel 10 and the longitudinal center axis 21 of the base 25 are aligned. In addition, the short edge 13 of the shingle panel 10 and the short edge 23 of the base 25 are also aligned. For the purposes of this specification, the end of the shingle 5 including the short edges of the shingle panel 10 and base 25 will be referred to as the trailing end, and the opposite end of the shingle 5 will be referred to as the front end.

The back member 20 has two side walls 22*a* and 22*b* extending from the base 25 along the base's longitudinal edges. The back member 20 also has eight longitudinal walls 24 extending from the base 25, which are parallel to the longitudinal axis 21 of the base 25, and eight transverse walls 26*a*–26*h* extending from the base 25, which are perpendicular to the longitudinal axis 21 of the base 25. Two of the transverse walls 26*a* and 26*e* are disposed along the front edges of the base 25.

The transverse walls 26*a*–26*h* are divided into two sets of four walls, which are disposed on opposite sides of the longitudinal center axis 21 of the base 25. The first set includes walls 26*a*–26*d*, and the second set includes walls 26*e*–26*h*. In addition, wall 26*a* is disposed opposite wall 26*e*; wall 26*b* is disposed opposite wall 26*f*; wall 26*c* is disposed opposite wall 26*g*; and wall 26*d* is disposed opposite wall 26*h*. The opposing walls are offset from each other along the longitudinal center axis 21 by an amount A sufficient to ensure that they do not interfere with each other when the shingle 5 is folded—i.e., they are offset from each other by an amount greater than the width of each wall. To facilitate the folding of the shingle 5, the back member 20 preferably has a slit 27 in the base 25 along its longitudinal center axis 21. The base 25 also has rectangular holes 28 in the areas between some of the longitudinal walls 24 and the transverse walls 26*a*–26*h*. The holes 28 limit the twists and deformation of the base 25 under heat.

Figure 3:
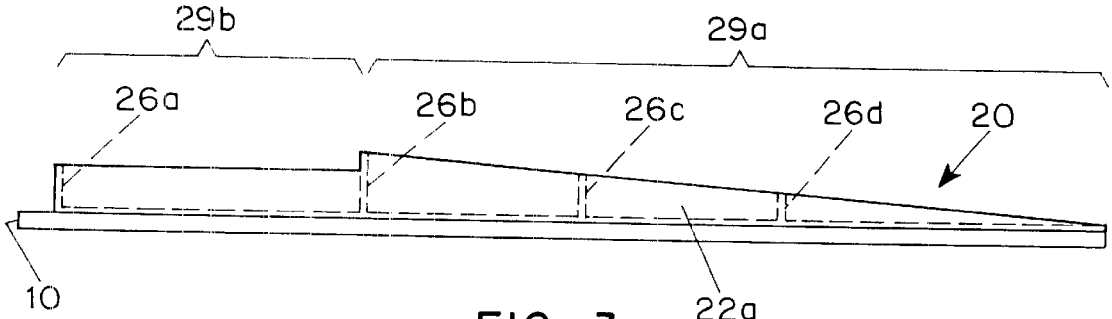
FIG. 3 is a side plan view of a shingle according to the embodiment of FIG. 1.

FIG. 3 is a side plan view of the shingle 5 of FIG. 1, viewed along an axis perpendicular to the longitudinal center axis 11 of the shingle panel 10. As shown in FIG. 3, the side wall 22*a* of the back member 20 is composed of a wedge-shaped section 29*a* and a rectangular section 29*b*. Transverse wall 26*b* is positioned at the juncture between sections 29*a* and 29*b*. At the juncture of the wedge-shaped section 29*a* and rectangular section 29*b*, there is a step in the height of the side wall 22*a*—i.e., the height of the wedge-shaped section 29*a* is greater than the height of section 29*b*.

Side wall 22*b* is identical to sidewall 22*a*. At any point along the longitudinal axis of the back member 20, the height of each of the longitudinal walls 24 and the transverse walls 26*a*–26*h* corresponds to the height of the sidewalls 22*a* and 22*b* at that longitudinal position.

Figure 5:
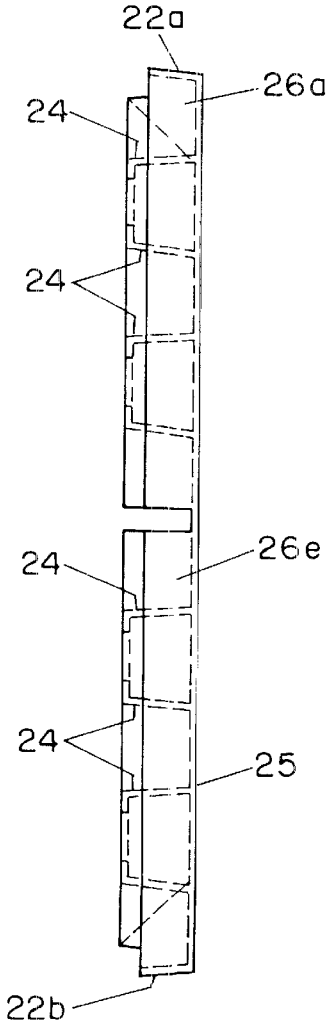
FIGS. 5 and 6 are side plan views of a shingle according to the embodiment of FIG. 1.
Figure 6:
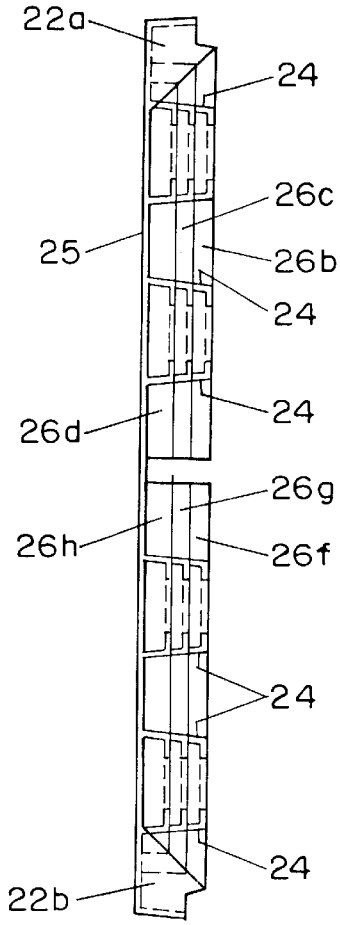
Figure 4:
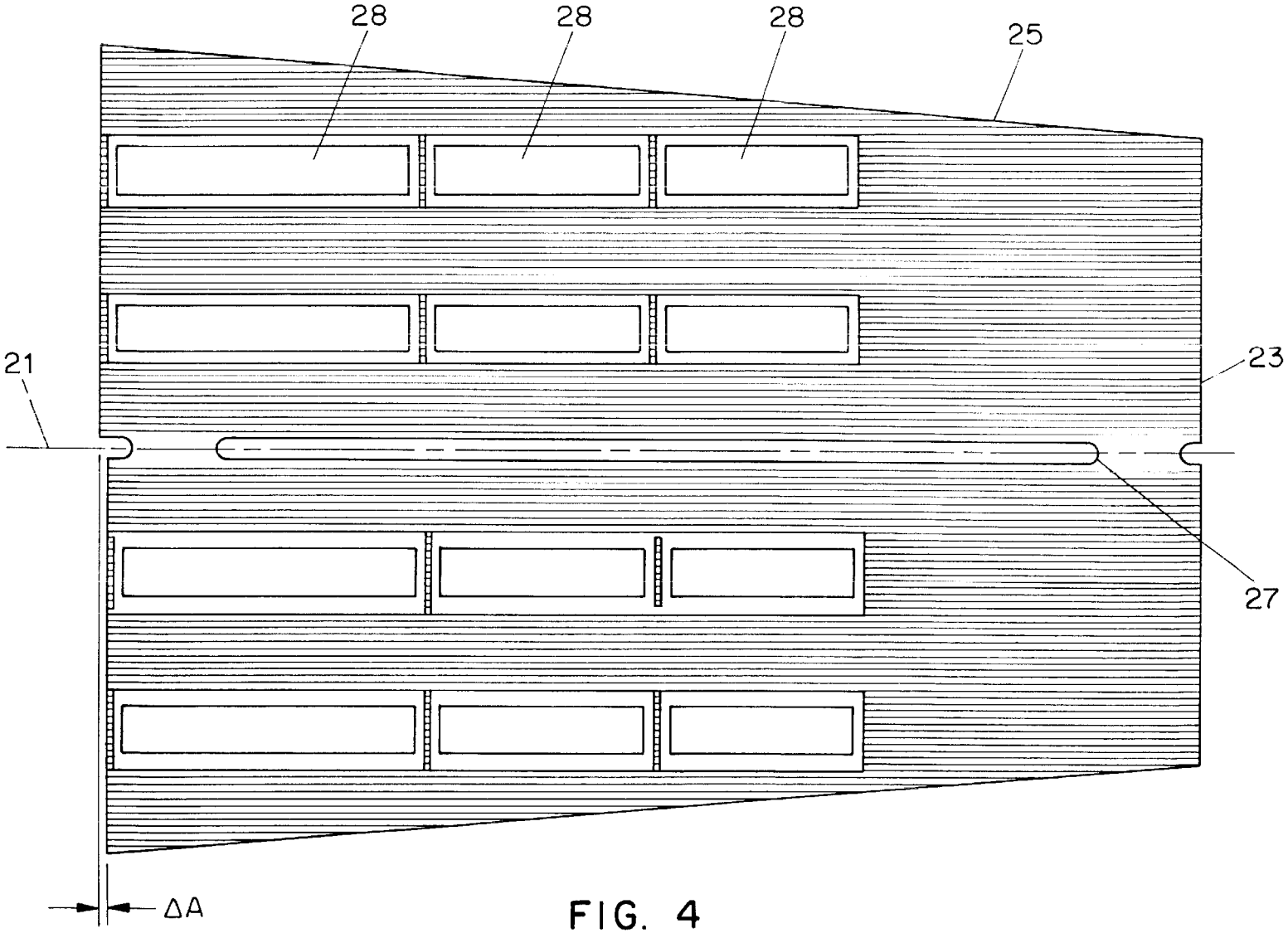
FIG. 4 is a top plan view of a back member of a shingle according to the embodiment of FIG. 1.

FIG. 4 is a top plan view of the back member 20. The top surface of the base 25 is preferably corrugated, with the corrugations running longitudinally along the base 25. The corrugations facilitate the adherence of the back member 20 to the shingle panel 10. FIGS. 5 and 6 are side plan views of the back member 20 viewed along axes parallel to the longitudinal center axis 21 of the back member 20. FIGS. 5 and 6 further illustrate the features of the back member 20 discussed above.

Figure 7:
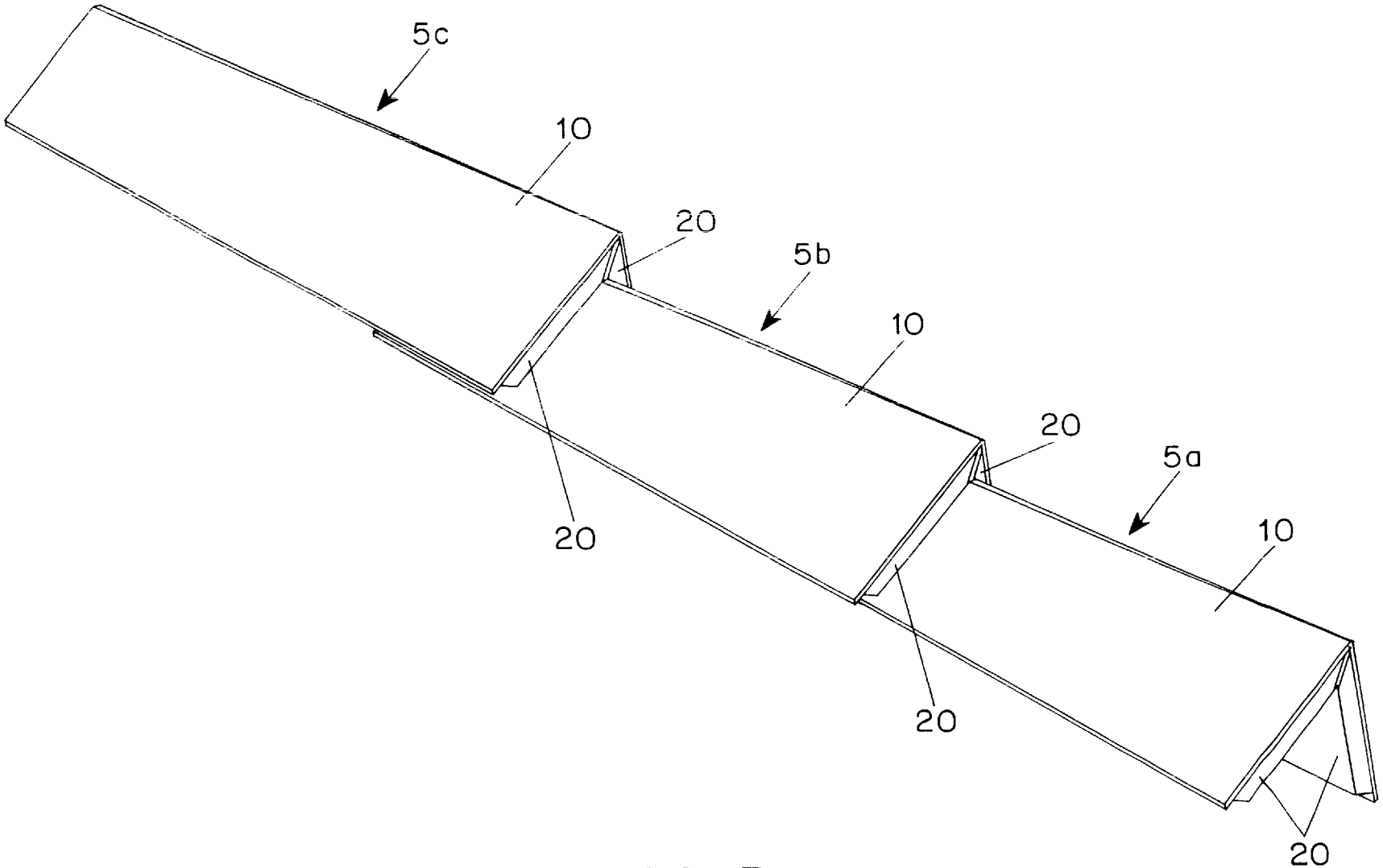
FIG. 7 is an isometric view of the placement of a series of shingles after installation, each shingle constructed according to the embodiment of FIGS. 1 to 6.

FIG. 7 is an isometric view of the placement of a series of shingles 5*a*, 5*b*, and 5*c* after installation on a hip, ridge, or rake portion of a roof. Each of the shingles 5*a*, 5*b*, and 5*c* is a shingle according to the embodiment of FIGS. 1 to 6, with the shingle panel 10 folded along its longitudinal center axis 11 (see FIG. 2) to form an inverted V-shape with the back member 20 inside of the shingle panel 10. To begin the installation, shingle 5*a* is placed on the hip, ridge, or rake portion of the roof and installed by nailing or other suitable means. Shingle 5*b* is then placed on top of shingle 5*a*, with the front end of shingle 5*b* placed on the trailing end of shingle 5*a*. The front end of shingle 5*b* is then slid toward the front end of shingle 5*a* until the step of the back member 20 of shingle 5*b* engages the edges at the trailing end of shingle 5*a*. Shingle 5*b* is then nailed or otherwise suitably fastened in place on the roof. Shingle 5*c* is installed in the same manner over shingle 5*b*.

As will be appreciated by those skilled in the art, shingles according to the present invention provide the following benefits. First, the step of the back member 20 allows the shingles to be easily aligned with each other for a quick and uniform installation. Second, the thickness of the back member 20 enhances the appearance of the shingles and provides a wood-like look to the shingles. Third, since the back member 20 is substantially the same length as the shingle panel 10, the thickness of each shingle is enhanced across its entire length, and the shingles thereby avoid an exaggerated "saw-tooth" appearance after installation. Finally, since the back member 20 of each shingle is made of a rigid material, the shingles will not droop over time or under heat and lose their thick, wood-like appearance.

Figure 8:
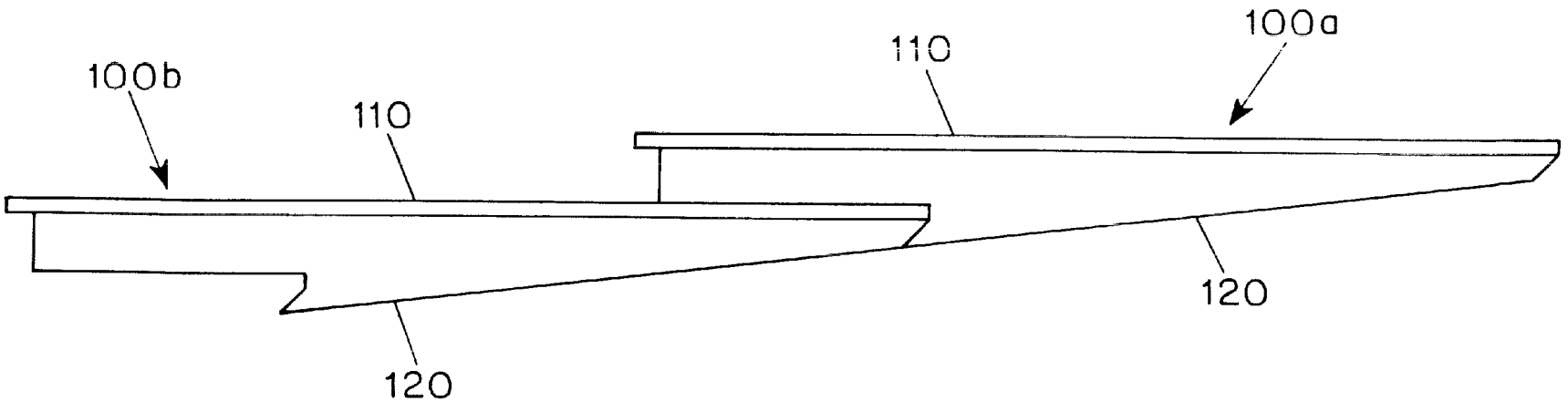
FIG. 8 is a side plan view of a pair of shingles according to another preferred embodiment of the present invention.

FIG. 8 is a side plan view of a pair of shingles 100*a* and 100*b* according to another preferred embodiment of the present invention. Each of the shingles 100*a* and 100*b* includes a shingle panel 110 and a back member 120 similar to the shingle panel 10 and back member 20, respectively, of FIGS. 1 to 6. A difference between the back member 120 of FIG. 8 and the back member 20 of FIGS. 1 to 6 is that the step of the back member 120 is angled so that when the shingles 100*a* and 100*b* are installed, the shingles 100*a* and 100*b* interlock with one another.

FIGS. 9 to 12 illustrate a shingle 200 according to another preferred embodiment of the present invention, which incorporates a ventilation function for "ridge vent" systems. Presently, many homes are constructed such that the peak of a roof has an opening of approximately two inches along its length. This opening is covered by a special "ridge vent" material that allows air to pass out of the home, but prevents insects and moisture from entering into the home. The "ridge vent" material is then covered by standard ridge shingle products. Clearly, a two-step process is currently necessary for the installation of shingles on homes using a "ridge vent" system.

Figure 9:
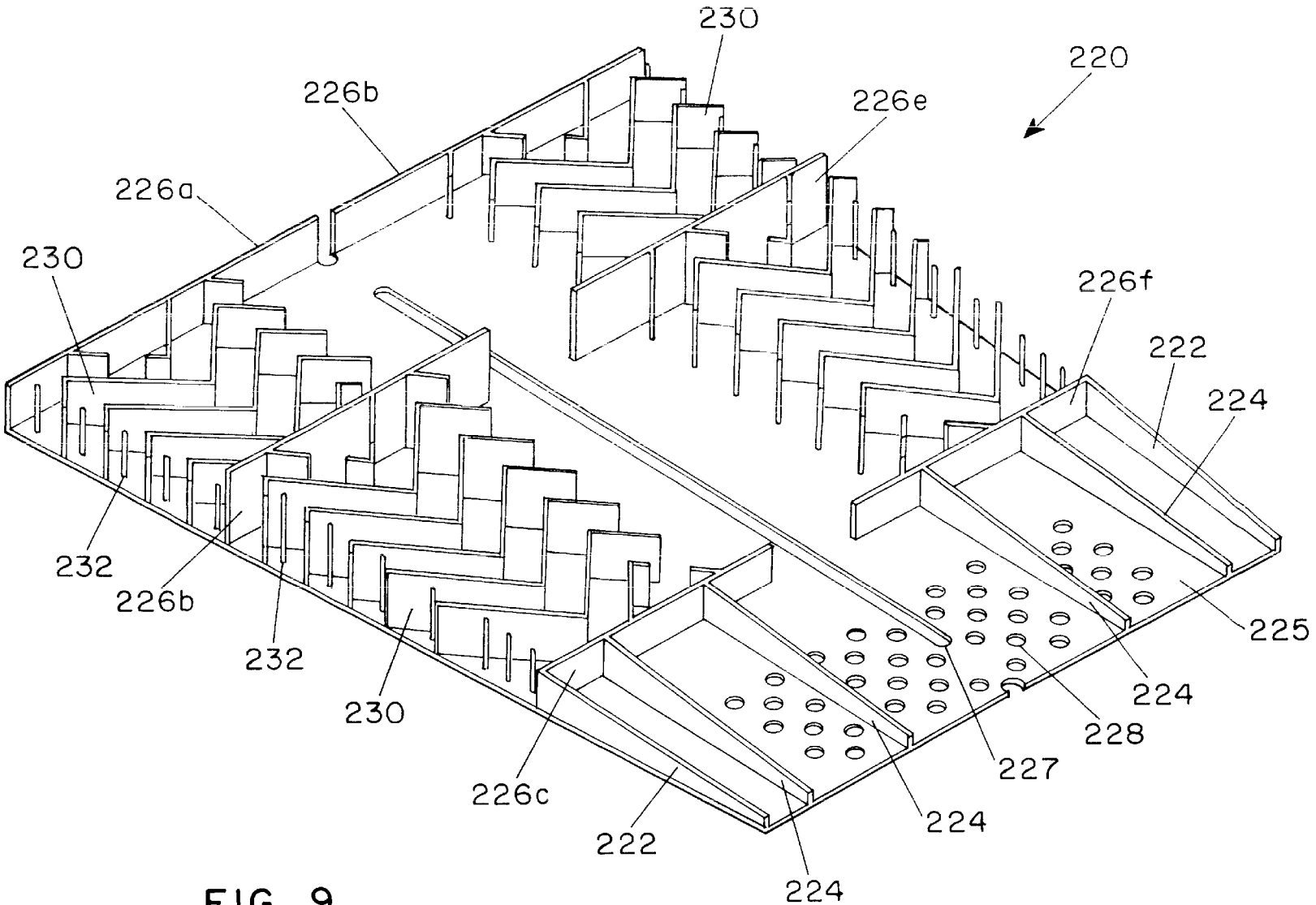
FIG. 9 is an isometric view of a back member of a shingle according to another preferred embodiment of the present invention.
Figure 10:
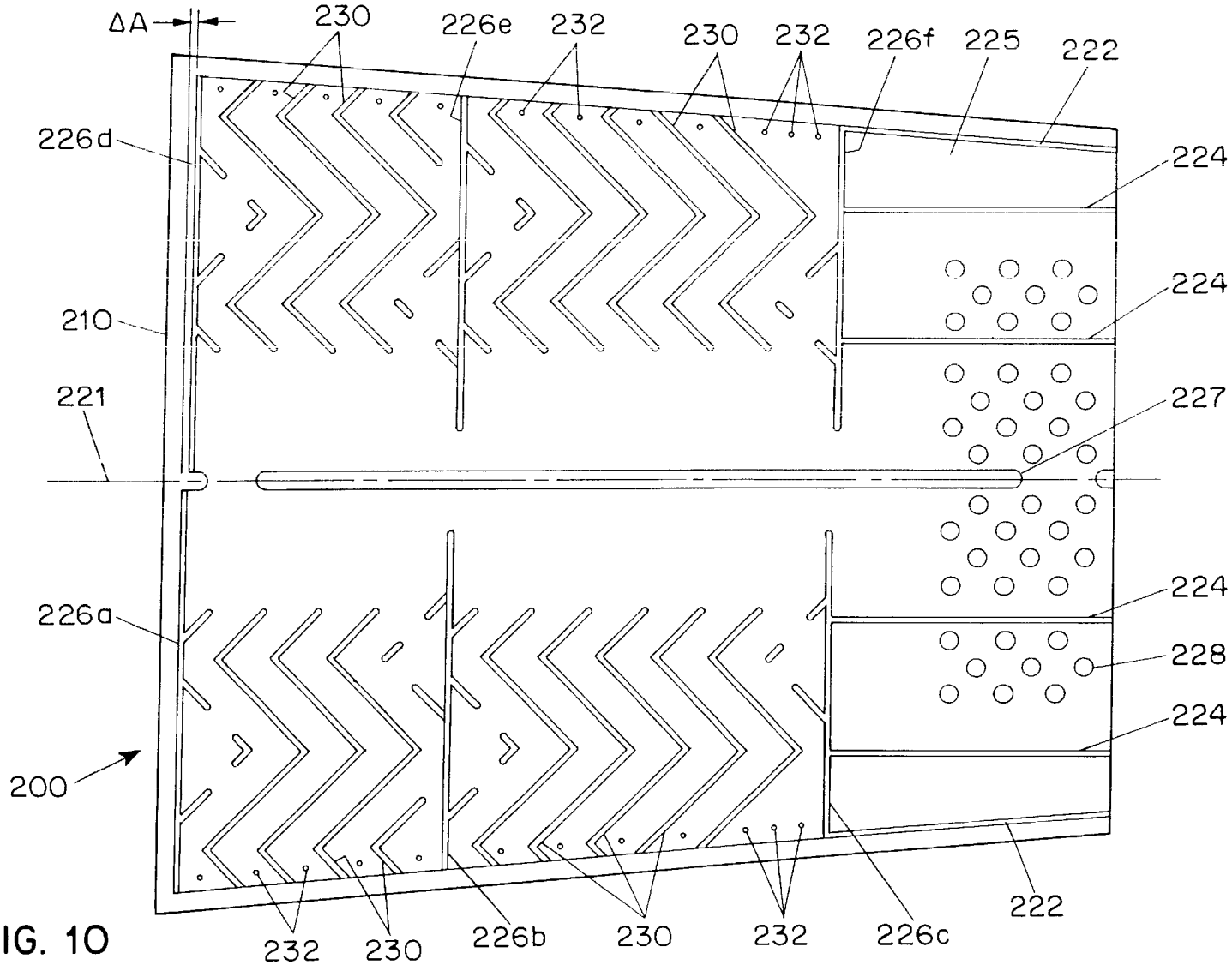
FIG. 10 is a bottom plan view of a shingle including a back member according to the embodiment of FIG. 9.

FIG. 9 is an isometric view of a back member 220 according to a preferred embodiment of the present invention, and FIG. 10 is a bottom plan view of the back member 220. As in the previous embodiments, the back member 220 includes a trapezoid-shaped base 225. The base 225 includes a slit 227 along its longitudinal center axis 221 to facilitate the folding of the back member 220.

Six transverse walls 226*a*–226*f* extend from the base 225 and run in a direction perpendicular to the longitudinal center axis 221 of the base 225. The transverse walls 226*a*–226*f* are divided into two sets of three walls, which are disposed on opposite sides of the longitudinal center axis 221. The first set includes walls 226*a*–226*c*, and the second set includes walls 226*d*–226*f*. In addition, wall 226*a* is disposed opposite wall 226*d*; wall 226*b* is disposed opposite wall 226*e*; and wall 226*c* is disposed opposite wall 226*f*. The opposing walls are offset from each other along the longitudinal center axis 221 by an amount A sufficient to ensure that they do not interfere with each other when the shingle 200 is folded—i.e., they are offset from each other by an amount greater than the width of each wall.

Between the trailing edge of the base 225 and the transverse walls 226*c* and 226*f*, four walls 224 parallel to the longitudinal center axis 221 of the back member 220 extend from the base 225. In addition, in this area, there are disposed two side walls 222 extending from the longitudinal edges of the base 225.

Between the transverse walls 226*a* and 226*c* and the transverse walls 226*d* and 226*f*, there are disposed a plurality of channel walls 230 extending from the base 225. The channel walls 230 are preferably arranged in a zig-zag or herringbone pattern and form channels communicating between the sides of the back member 220 and the central portion of the back member 220 (the area around the longitudinal center axis 221 of the back member 220). In addition, along the longitudinal edges of the base 225, there are disposed pins 232 extending from the base 225. Preferably, the pins 232 are spaced apart so that the width of each of the openings along the sides of the back member 225 is less than ¼ inch.

When a shingle 200 with back member 220 is placed on a ridge vent roof, the air being vented from the ridge of the roof passes through the channels formed by the channel walls 230 and into the outside environment. Advantageously, the zig-zag or herringbone pattern of the channel walls 230 prevents the entry of water into the ridge vent by forcing the water to take a tortuous path through the back member 220. In addition, the pins 232 prevent the penetration of insects into the back member 220 by restricting the width of the openings in the sides of the back member 220. Accordingly, the installation of ridge vent material underneath the shingle 200 is not necessary, and only a one-step installation process is necessary to install shingles according to this embodiment on a ridge vent roof.

Figure 11:
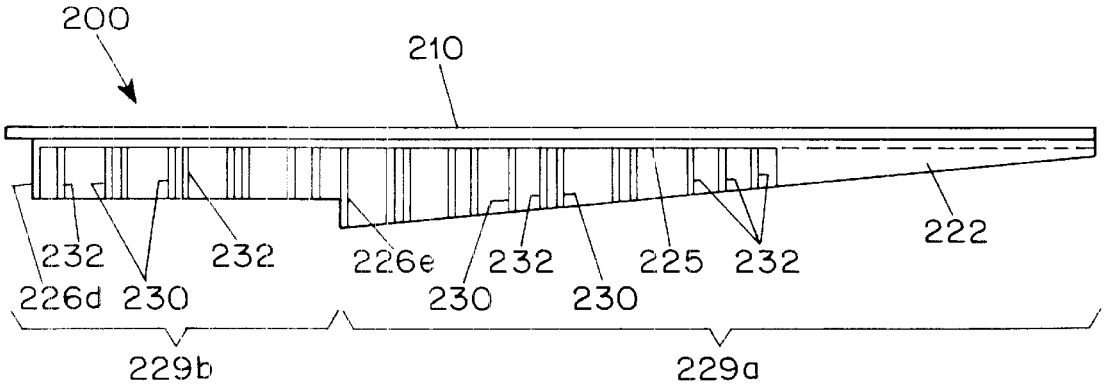
FIG. 11 is a side plan view of a shingle according to the embodiment of FIG. 10.

FIG. 11 is a side plan view of the back member 220, showing the back member 220 includes the same step feature as the back member 20 of FIGS. 1 to 6. Dividing the back member 220 into two sections 229*a* and 229*b* for the purposes of discussion (with the transverse wall 226*e* serving as the partition between the two sections), the walls in section 229*a* increase in height along the longitudinal axis of the back member 220 from the trailing edge of the base 225 to the transverse wall 226*e*. In section 229*b*, all of the walls have the same height, which is less than that of the transverse wall 226*e*. The difference in height between the walls in section 229*a* and the walls in section 229*b* provides the step in thickness of the back member 220.

Figure 12:
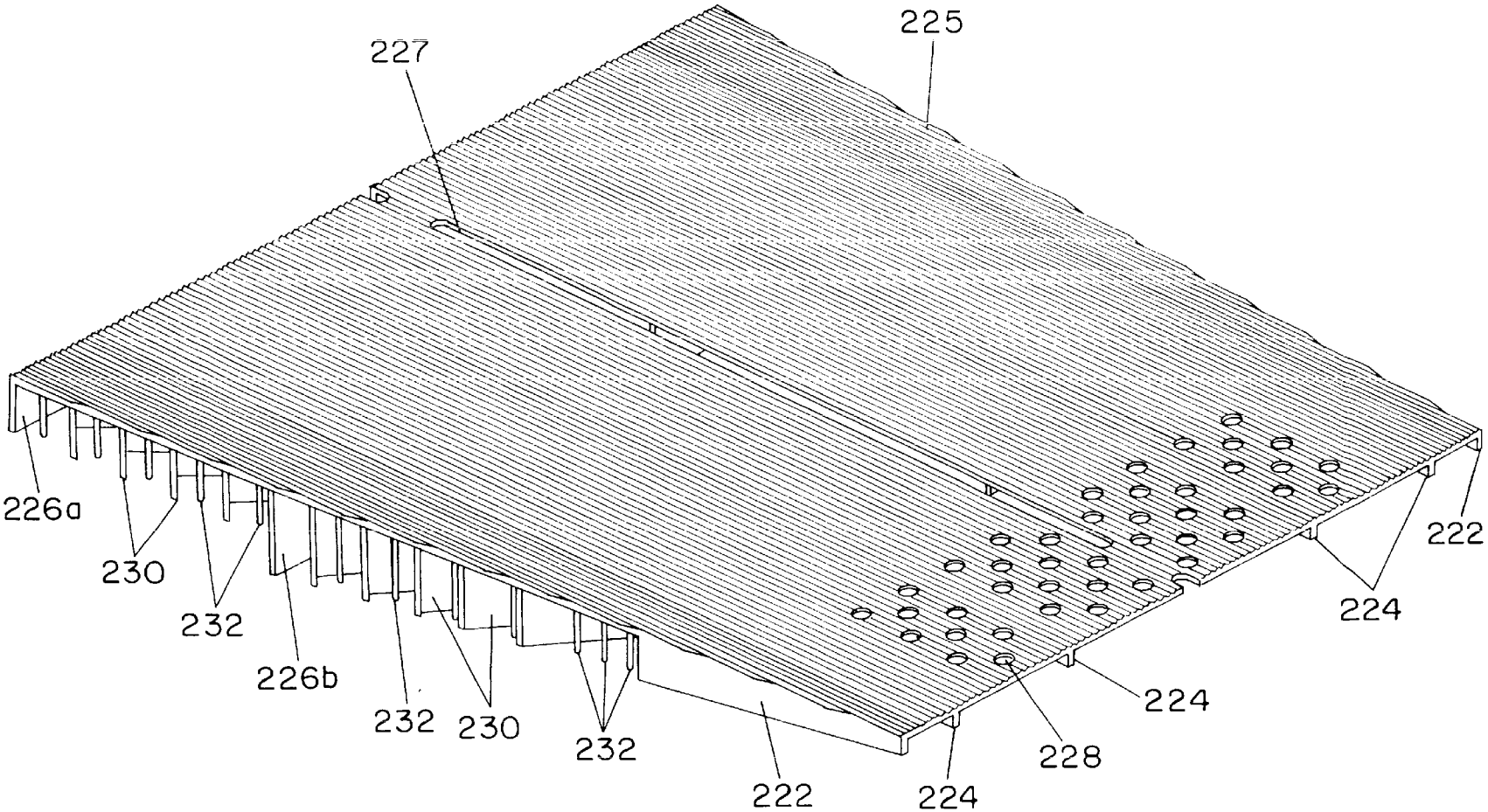
FIG. 12 is an isometric view of a back member according to the embodiment of FIG. 9.

FIG. 12 is an isometric view of the back member 220. The top surface of the base 225 is preferably corrugated, with the corrugations running longitudinally along the base 225. The corrugations facilitate the adherence of the back member 220 to the shingle panel 210.

As shown in FIGS. 9, 10, and 12, between the trailing edge of the base 225 and the transverse walls 226*c* and 226*f*, there are disposed a plurality of circular holes 228 in the base 225. If the shingle panel 210 is made shorter than the base 225 (not shown), the holes 228 provide a further of means of ventilation for the air escaping the ridge vent of the roof.

Figure 13:
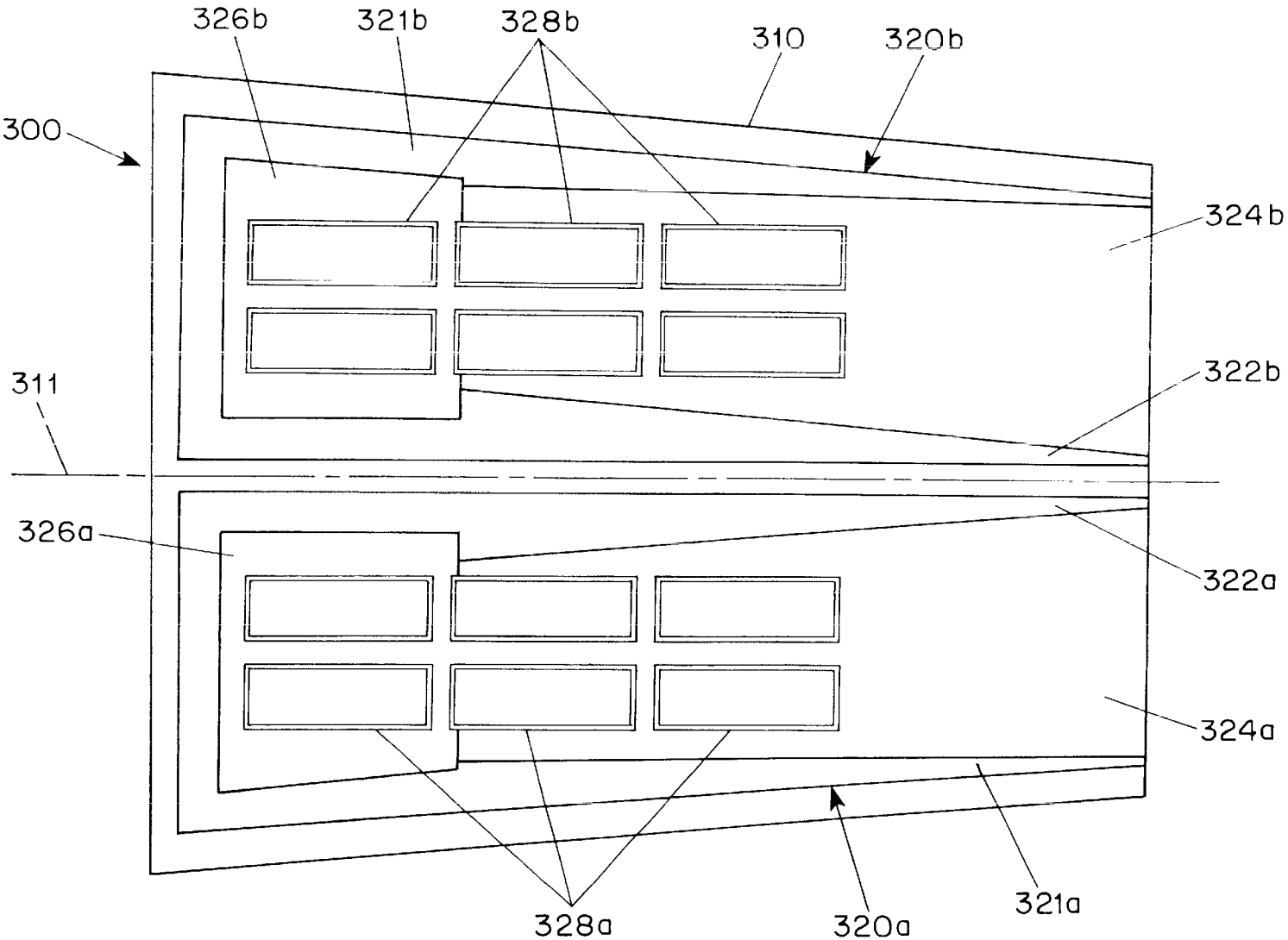
FIG. 13 is a bottom plan view of a shingle according to another preferred embodiment of the present invention.

FIG. 13 is a bottom plan view of a shingle 300 according to another preferred embodiment of the present invention. The shingle 300 includes a shingle panel 310 having attached thereto two back members 320*a* and 320*b*. The back members 320*a* and 320*b* are mirror images of each other and are placed on the shingle panel 310 in symmetrical relation with respect to the longitudinal center axis 311 of the shingle panel 310.

Figure 14:
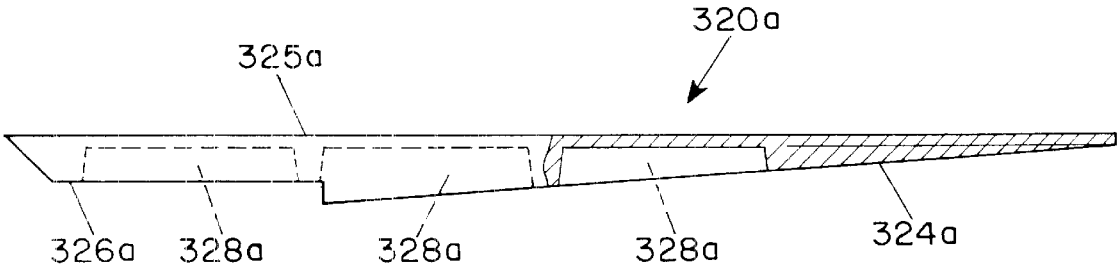
FIG. 14 is a side plan view of a back member of a shingle according to the embodiment of FIG. 13.

FIG. 14 is a side plan view of back member 320*a*, viewed from an axis perpendicular to the longitudinal center axis 311 of the shingle panel 310. (The corresponding side plan view of back member 320*b* is the same.) The back member 320*a* includes a planar base surface 325*a*, which is attached to the shingle panel 310. Opposite the planar base surface 325*a*, the back member has a planar surface 324*a* that is inclined with respect to the base surface 325*a* and a planar surface 326*a* that is parallel to the base surface 325*a*. At the juncture between the surfaces 324*a* and 326*a*, the height of surface 324*a* is greater than the height of surface 326*a*, thereby producing a step in the thickness of the back member 320*a*. The back members 320*a* and 320*b* preferably include a plurality of rectangular-shaped cavities 328*a* and 328*b* therein, respectively, which lighten the back members and reduce the material needed to construct them.

Figure 15:
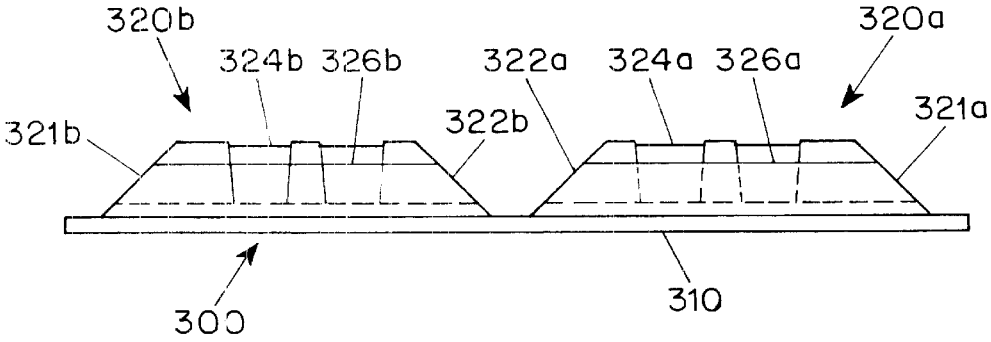
FIG. 15 is a side plan view of a shingle according to the embodiment of FIG. 13.

FIG. 15 is a side plan view of shingle 300, viewed from the front end along an axis parallel to the longitudinal center axis 311 of the shingle panel 310. The back member 320*a* has side walls 321*a* and 322*a*, and the back member 320*b* has side walls 321*b* and 322*b*. The side walls of each back member 320*a* and 320*b* are angled inwardly with respect to each back member 320*a* and 320*b*. The angling of side walls 322*a* and 322*b* is necessary to ensure that these side walls do not interfere with each other when the shingle panel 310 is folded.

Although the present invention has been described with reference to certain preferred embodiments, various modifications, alterations, and substitutions will be apparent to those skilled in the art without departing from the spirit and scope of the invention, as defined by the appended claims.

We claim:

1. A hip, ridge, or rake shingle comprising:

a shingle panel having a substantially planar lower surface and an upper surface; and at least one rigid back member having a length substantially the same as or greater than the length of said shingle panel and attached to said substantially planar lower surface of said shingle panel, said at least one rigid back member having a step in thickness in a cross-sectional plane perpendicular to said substantially planar lower surface and parallel to the longitudinal axis of said at least one rigid back member, the thickness of said at least one rigid back member at a high level of said step being greater than the thickness of said at least one rigid back member at an end of said at least one rigid back member.

2. The hip, ridge, or rake shingle of claim 1, wherein said shingle panel is composed of an asphalt material and said upper surface of said shingle panel includes a granular material thereon.

3. The hip, ridge, or rake shingle of claim 2, wherein said shingle panel further comprises a rubberized material.

4. The hip, ridge, or rake shingle of claim 3, wherein said rubberized material is a styrene-butadiene-styrene block copolymer.

5. The hip, ridge, or rake shingle of claim 1, wherein said step is capable of interlocking with an end of a shingle which is substantially identical to said hip, ridge, or rake shingle.

6. The hip, ridge, or rake shingle of claim 1, wherein said at least one rigid back member includes channels having openings formed therein communicating between a side of said at least one rigid back member and an area near the longitudinal center axis of said shingle panel, whereby when said shingle is installed on a ridge vent roof, said channels allow ventilation of the roof to the outside environment.

7. The hip, ridge, or rake shingle of claim 6, wherein said channels are arranged in a zig-zag or herringbone pattern.

8. The hip, ridge, or rake shingle of claim 6, wherein the width of the openings of said channels along the sides of said at least one rigid back member is less than or equal to ¼ inch.

9. The hip, ridge, or rake shingle of claim 6, wherein said at least one rigid back member includes a trapezoid-shaped base having longitudinal edges and a plurality of walls extending from said base, said plurality of walls forming said channels.

10. The hip, ridge, or rake shingle of claim 9, wherein said at least one rigid back member includes a plurality of pins extending from the longitudinal edges of said base.

11. The hip, ridge, or rake shingle of claim 1, wherein said at least one rigid back member includes a planar base surface that is attached to said substantially planar lower surface of said shingle panel, a surface inclined with respect to said planar base surface, and a surface parallel to said planar base surface; and wherein said step in thickness of said at least one rigid back member is formed at the juncture of said inclined surface and said parallel surface.

12. The hip, ridge, or rake shingle of claim 11, wherein said at least one rigid back member includes cavities formed therein.

13. The hip, ridge, or rake shingle of claim 1, wherein said at least one rigid back member is composed of an injection-molded thermoplastic material.

14. The hip, ridge, or rake shingle of claim 13, wherein said thermoplastic material is selected from the group consisting essentially of polystyrene, polypropylene, polyethylene, ethylene-vinyl-acetate (EVA), ethylene-mythylene-acrylate (EMAC), neoprene, and polychlorosulfonated polymer (Hypalon).

* * * * *

UNITED STATES PATENT AND TRADEMARK OFFICE

CERTIFICATE OF CORRECTION

PATENT NO. : 6,530,189 B2
DATED : March 11, 2003
INVENTOR(S) : Freshwater et al.

It is certified that error appears in the above-identified patent and that said Letters Patent is hereby corrected as shown below:

Title page,
Item [56], References Cited, OTHER PUBLICATIONS,
Under "ASTM 03381-92", "Visosity" should read -- Viscosity --;
Under "Dupont", "Dupont" should read -- DuPont --;
Under "Shell", (first occurrence) "Sealents" should read -- Sealants --;
Under "Shell", (second occurrence) "Tupical" should read -- Typical --; and
"Glob Chem" should read -- GlobChem --; and
Under "Greenstreak", (first occurrence) "Techical" should read -- Technical --

Column 4,
Line 3, "copolymier" should read -- copolymer --

Column 5,
Line 15, "mooney" should read -- Mooney --

Column 7,
Table 4, "buradiene-" with -- butadiene- --

Column 9,
Line 31, "ethylene-mythylene-acrylate" should read -- ethylene-methylene-acrylate --

Column 14,
Line 41, "mythylene-acrylate" should read -- methylene-acrylate --

Signed and Sealed this

Twenty-third Day of September, 2003

JAMES E. ROGAN
*Director of the United States Patent and Trademark Office*